US006700320B2

(12) United States Patent
Lee et al.

(10) Patent No.: US 6,700,320 B2
(45) Date of Patent: Mar. 2, 2004

(54) CATHODE RAY TUBE WITH STRUCTURE FOR PREVENTING ELECTRON BEAM MIS-LANDING CAUSED BY GEOMAGNETISM

(75) Inventors: Eung-Suk Lee, Seoul (KR); Jong-Heon Kim, Suwon (KR)

(73) Assignee: Samsung SDI Co., Ltd., Suwon (KR)

( * ) Notice: Subject to any disclaimer, the term of this patent is extended or adjusted under 35 U.S.C. 154(b) by 71 days.

(21) Appl. No.: 10/138,487

(22) Filed: May 6, 2002

(65) Prior Publication Data

US 2002/0171348 A1 Nov. 21, 2002

(30) Foreign Application Priority Data

May 18, 2001 (KR) ..... 2001/27250

(51) Int. Cl.[7] ..... H01J 29/80
(52) U.S. Cl. ..... 313/402; 313/407; 313/313
(58) Field of Search ..... 313/402, 407, 313/408, 239, 313, 479

(56) References Cited

U.S. PATENT DOCUMENTS 4,949,008 A * 8/1990 Chihara ..... 313/402
6,597,100 B2 * 7/2003 Kobayashi ..... 313/479

FOREIGN PATENT DOCUMENTS

JP 10-50228 2/1998

* cited by examiner

*Primary Examiner*—Vip Patel
(74) *Attorney, Agent, or Firm*—Robert E. Bushnell, Esq.

(57) ABSTRACT

A cathode ray tube includes a panel having a front screen portion on which a phosphor screen is formed and a panel flange formed on an edge of the front screen portion; a funnel connected to the panel flange; a deflection yoke disposed around the funnel; a neck connected to the funnel, an electron gun disposed in the neck; a color selection apparatus for selecting electron beams emitted from the electron gun and allowing the selected electron beams to land on corresponding phosphors, the color selection apparatus including a frame having a pair of supporting members disposed at a predetermined distance from each other in parallel and a pair of elastic members fixed on both ends of the supporting members to correspond to the lateral sides of the mask; and a shield apparatus for shielding geomagnetism, the shield apparatus being mounted on a circumference of the frame of the color selection apparatus and extended toward the neck. The shield apparatus includes disconnection parts defined corresponding to the corners of the frame, the shield apparatus being extended toward the phosphor screen over one of longitudinal and lateral side-walls of the frame.

20 Claims, 7 Drawing Sheets

CATHODE RAY TUBE WITH STRUCTURE FOR PREVENTING ELECTRON BEAM MIS-LANDING CAUSED BY GEOMAGNETISM

CLAIM OF PRIORITY

This application makes reference to, incorporates the same herein, and claims all benefits accruing under 35 U.S.C. §119 from an application for CATHODE RAY TUBE HAVING MEANS FOR PREVENTING MIS-LANDING OF ELECTRON BEAMS BY EARTH MAGNETISM earlier filed in the Korean Industrial Property Office on May 18, 2001 and there duly assigned Serial No. 2001-27250.

BACKGROUND OF THE INVENTION

1. Technical Field

The present invention relates to a cathode ray tube (CRT), and more particularly, to a cathode ray tube with a structure for preventing electron beam mis-landing caused by geomagnetism.

2. Related Art

Generally, a CRT is designed to realize an image by scanning a phosphor screen deposited with red R, green G, and blue B phosphors with electron-beams emitted from an electron gun.

The electron beams are deflected by a deflection yoke and landed on desired phosphors to scan the peripheral portion of the phosphor screen as well as the central portion.

However, when the electron beams are deflected, they are affected by outer magnetic fields such as geomagnetism, and the electron beams can be landed on an undesired phosphor. This so-called mis-landing deteriorates the color purity of the cathode ray tube.

To solve the above problem, a magnetic field shield member such as an inner shield for shielding the electron beams from geomagnetism has been employed in the CRT. The inner shield is generally mounted on a color selection apparatus composed of a shadow mask and a mask frame, which is disposed inside the cathode ray tube.

In recent years, a flat screen panel has been developed to improve the definition of an image realized at a peripheral portion of the large-sized screen. Accordingly, the color selection apparatus employed to realize colors in the CRT has been also flattened and increased in size so that it can be properly associated with the flat screen panel.

That is, a color selection apparatus includes a shadow mask provided with plural electron-beam-passing apertures and a frame for supporting the shadow mask applied with a predetermined tension. The frame includes a pair of elastic members and a pair of supporting members coupled to the elastic members, the shadow mask being mounted on the supporting members.

Such a color selection apparatus is mounted inside a panel on an inner surface of which a phosphor screen is formed. An inner shield is mounted on the supporting members and the elastic members such that it encloses electron beam emission traces to shield the electron beams from the geomagnetism.

Geomagnetism includes a vertical component and a horizontal component. The horizontal component can be classified as a north-south direction component (N-S component) that is in parallel with a tube axis, and an east-west direction component (E-W component) that is perpendicular to the tube axis. In the related art, to shield the electron beams from the horizontal component, a V-shaped notch or a piercing portion is formed on the inner shield.

However, the color selection apparatus still has a weakness against the E-W component of the geomagnetism.

That is, the E-W component is applied to lateral sides of the panel in a longitudinal direction. Therefore, since a space between the elastic members and the shadow mask and a space between the shadow mask and the phosphor screen are not shielded from the inner shield, the electron beams passing through these spaces are affected by the E-W component. This causes the electron beams to land on undesired phosphors, deteriorating the color purity of the cathode ray tube.

To solve the above problems, Japanese unexamined patent application having publication number No. H10-50228 for a *Color Cathode-ray Tube* by Teruhisa discloses a color cathode ray tube having shielding means for shielding the electron beams from outer magnetic fields applied between the color selection apparatus and the phosphor screen at the corners of the frame. However, since the shielding means is designed to enclose the corners of the frame, the amount of horizontal shift of the electron beams may be increased.

That is, when the shielding means is designed to cover the corners of the frame, the part of geomagnetism applied to the lateral sides of the frame flows into the longitudinal sides. Accordingly, the electron beams directed toward the corners are affected by the geomagnetism, and as a result, the amount of horizontal shift of the electron beams is increased. This causes the electron beams to land on undesired phosphors, deteriorating the color purity at the corners of the screen of the cathode ray tube.

SUMMARY OF THE INVENTION

Therefore, the present invention has been made in an effort to solve the above-described and other problems.

It is therefore an objective of the present invention to provide a cathode ray tube that is designed to minimize the effect on the electron beams by the geomagnetism, thereby improving the color purity of the cathode ray tube by enhancing the beam-landing accuracy.

It is another objective to provide a cathode ray tube that is designed to minimize the effect on the electron beams by geomagnetism and yet be easy and cost efficient to manufacture.

It is still another objective to provide an apparatus in a cathode ray tube that is designed to minimize the effect on the electron beams by geomagnetism while avoiding to affect the electrons beams in any other manner by the apparatus.

To achieve the above and other objectives, the present invention provides a cathode ray tube, including a panel having a front screen portion on which a phosphor screen is formed and a panel flange formed on an edge of the front screen portion; a funnel connected to the panel flange; a deflection yoke disposed around the funnel; a neck connected to the funnel; an electron gun disposed in the neck; a color selection apparatus for selecting electron beams emitted from the electron gun and allowing the selected electron beams to land on corresponding phosphors, the color selection apparatus including a frame having a pair of supporting members disposed at a predetermined distance from each other in parallel and a pair of elastic members fixed on both ends of the supporting members to correspond to lateral sides of the mask; and a shield apparatus for shielding geomagnetism, the shield apparatus being mounted on a perimeter of the frame of the color selection apparatus and extended toward the neck, wherein the shield apparatus includes disconnection parts defined corresponding to corners of the frame, the shield apparatus being extended toward the phosphor screen over one of longitudinal and lateral sidewalls of the frame.

According to an embodiment, the shield apparatus includes a main shield member having a body provided with an electron beam-passing opening and extended toward the neck, and a skirt extended from the body and disposed on longitudinal sides of the frame; and a sub-shielding member disposed on lateral sides of the frame.

Preferably, the skirt is fixed on the supporting members while covering a center of the supporting members. The skirt is formed to be asymmetrical with reference to a central portion of the supporting members.

Preferably, the main shield member is mounted on the frame while not enclosing the elastic members, and the sub-shield member includes a shielding part disposed along the lateral sides of the frame to cover a space defined between the mask and the elastic members; and coupling parts extended from the shielding part and fixed on the elastic members.

Preferably, a width of the shielding part is greater than that of the frame.

Further, preferably the skirt is connected to the supporting members while satisfying the following condition:

$$0.01\ \text{mm} \leqq tk/L \leqq 0.15\ \text{mm}$$

where t is a thickness of the sub-shield member, k is a length of the skirt extending from the mask toward the phosphor screen over the supporting member, and L is a height of the supporting member.

Further, preferably the sub-shield member is fixed on the supporting member under the following condition:

$$0.01\ \text{mm} \leqq t'k'/L \leqq 0.15\ \text{mm}$$

where t' is a thickness of the sub-shield member, k' is a length of the sub-shield member from the mask toward the phosphor screen, and L' is a height of the supporting member.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENTS

Figure 7:
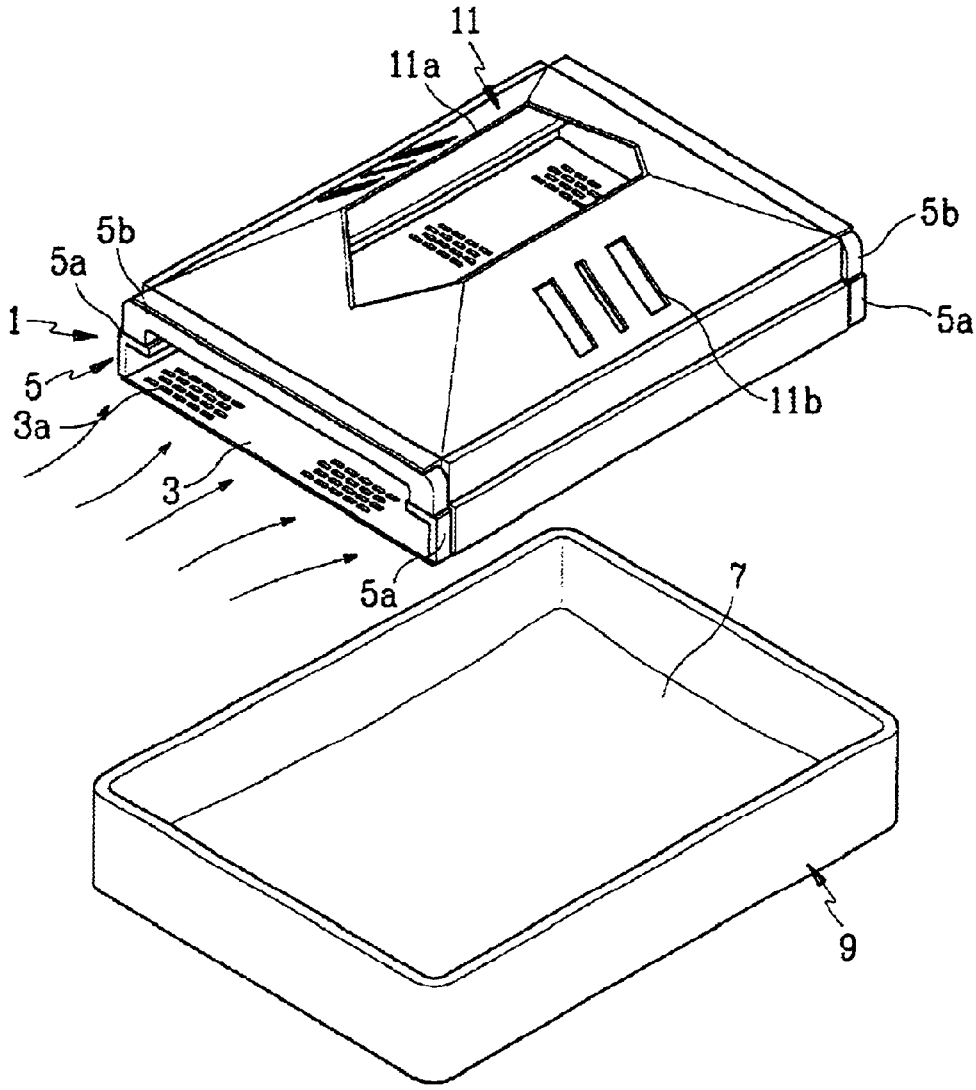
FIG. 7 (Related Art)
FIG. 7 is an exploded perspective view of a conventional cathode ray tube.

Turning now to the drawings, as shown in FIG. 7, a color selection apparatus 1 includes a shadow mask 3 provided with plural electron-beam-passing apertures 3*a* and a frame 5 for supporting the shadow mask applied with a predetermined tension. The frame 5 includes a pair of elastic members 5*b* and a pair of supporting members 5*a* coupled to the elastic members 5*b*, the shadow mask 3 being mounted on the supporting members 5*a*.

Such a color selection apparatus is mounted inside a panel 9 on an inner surface of which a phosphor screen 7 is formed. An inner shield 11 is mounted on the supporting members 5*a* and the elastic members 5*b* such that it encloses electron beam emission traces to shield the electron beams from the geomagnetism.

Geomagnetism includes a vertical component and a horizontal component. The horizontal component can be classified as a north-south direction component (N-S component) that is in parallel with a tube axis, and an east-west direction component (E-W component) that is perpendicular to the tube axis. In the related art, to shield the electron beams from the horizontal component, a V-shaped notch 11*a* or a piercing portion 11*b* is formed on the inner shield 11.

However, the color selection apparatus 1 still has a weakness against the E-W component of the geomagnetism.

Figure 4:
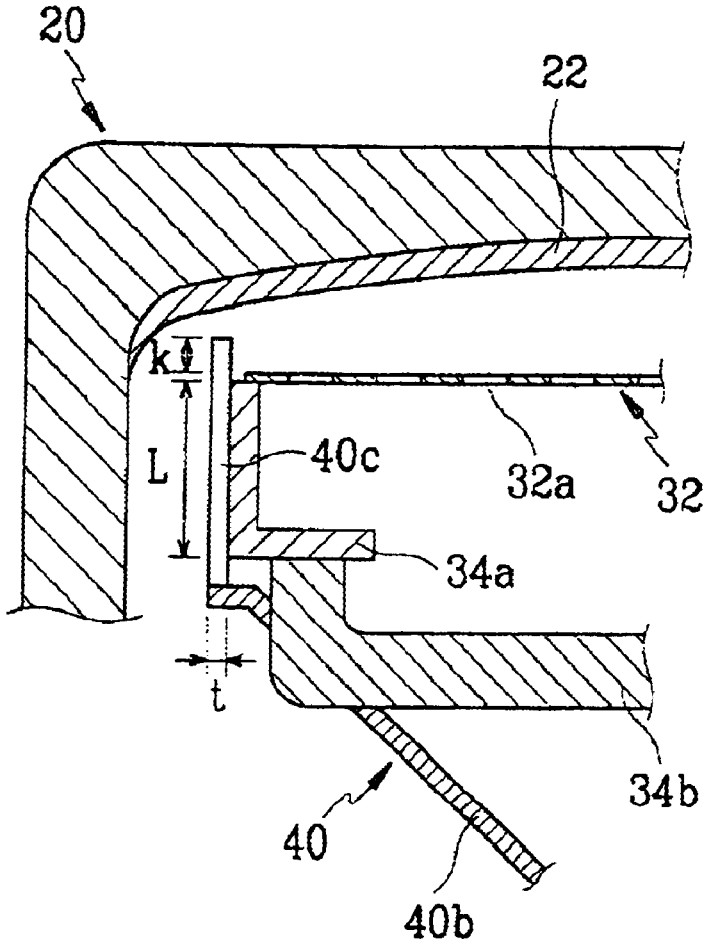
FIG. 4 is a partial sectional view taken along line III—III of FIG. 2.

That is, the E-W component is applied to lateral sides of the panel 9 in a longitudinal direction (see arrows in FIG. 4). Therefore, since a space between the elastic members 5*b* and the shadow mask 3 and a space between the shadow mask 3 and the phosphor screen 7 are not shielded from the inner shield 11, the electron beams passing through these spaces are affected by the E-W component. This causes the electron beams to land on undesired phosphors, deteriorating the color purity of the cathode ray tube.

Preferred embodiments of the present invention will be described in detail with reference to the accompanying drawings.

Figure 1:
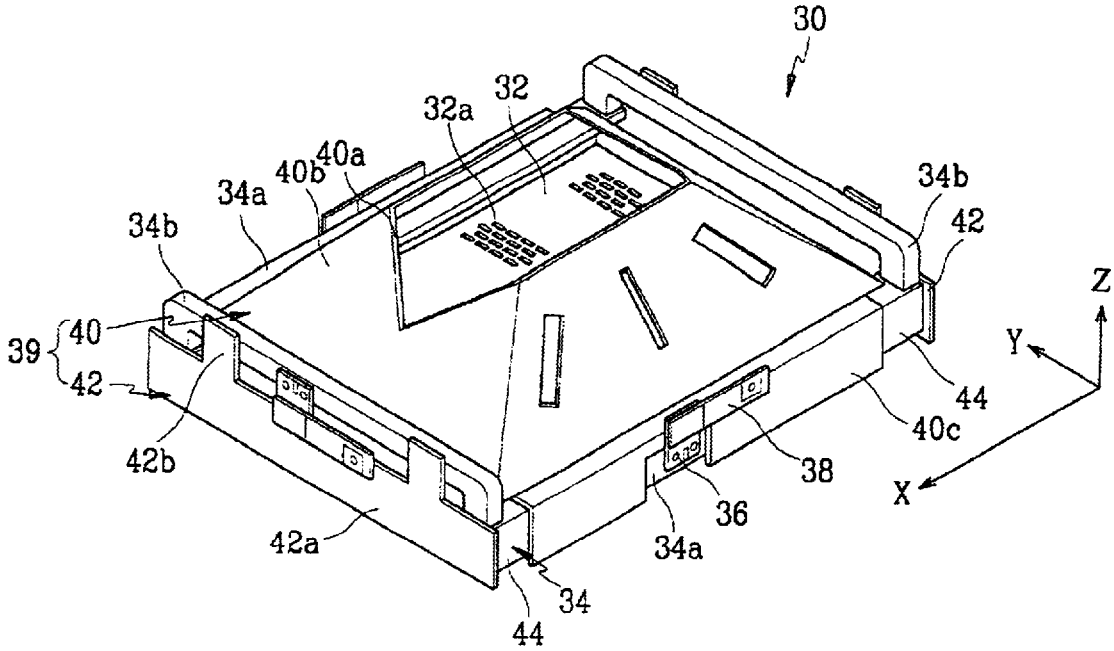
FIG. 1 is a perspective view of a color selection apparatus according to a preferred embodiment of the present invention.
Figure 2:
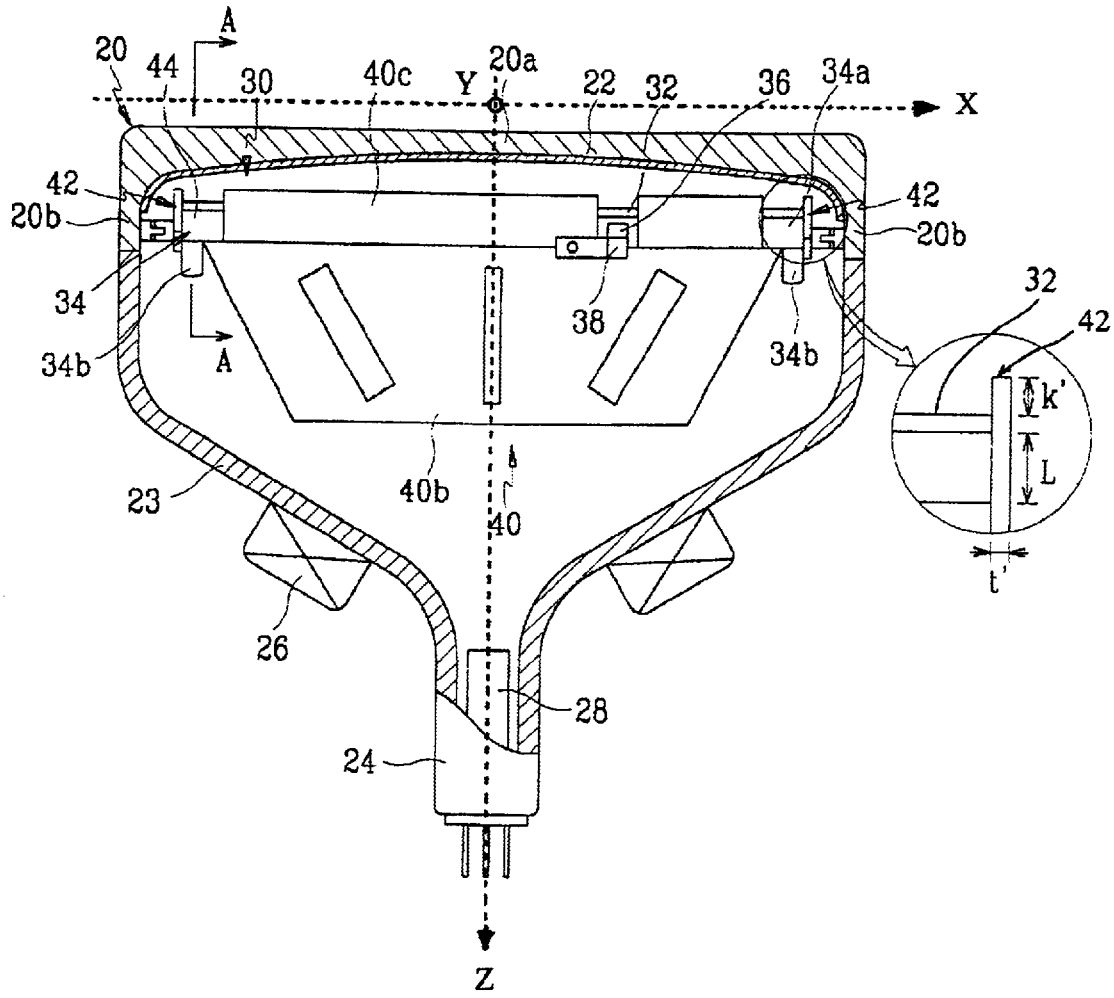
FIG. 2 is a sectional view of a cathode ray tube where a color selection apparatus according to a preferred embodiment of the present invention is employed.

FIG. 1 shows a color selection apparatus of the present invention and FIG. 2 shows a cathode ray tube having the color selection apparatus depicted in FIG. 1.

As shown in the drawings, a cathode ray tube includes a panel 20 having a screen portion 20*a*, on an inner surface of which a phosphor screen 22 is formed, and a panel flange 20*b* is integrally formed on an edge of the screen portion 20*a*. A funnel 23 connected to the panel flange 20*b* of the panel 20, and a neck 24 is connected to the funnel 23. A deflection yoke 26 is mounted around the funnel 23, and an electron gun 28 for emitting electron beams is mounted in the neck 24.

A color selection apparatus is disposed inside the panel 20 so as to select red R, green G, and blue B electron beams emitted from the electron gun 28. Such a color selection apparatus 30 is designed to employ a tensioned mask 32 provided with plural electron beam-passing apertures 32*a*.

The tensioned mask 32 is rectangular, having a longitudinal axis X and a lateral axis Y.

The mask is tensioned in a direction of the longitudinal axis X or the lateral axis Y, and is mounted on a frame 34. The frame 34 includes a pair of supporting members 34*a* disposed at a predetermined distance from each other in parallel along the longitudinal axis, and a pair of elastic members 34*b* disposed in parallel along the lateral axis and fixed on both ends of the supporting members 34*a* to define a rectangular frame with the supporting members 34*a*.

In this embodiment, the mask 32 is tensioned in a direction of the lateral axis Y and is welded on the top surfaces of the supporting members 34*a*. Each of the elastic members 34*b* is U-shaped to maintain the tensioned state of the mask 32. The tension applied to the periphery of the mask 32 is greater than that applied to the center of the mask 32.

The color selection apparatus 30 is disposed inside the panel 20 such that the tensioned mask 32 faces the phosphor screen 22. That is, the color selection apparatus 30 is mounted on the panel flange 20*b* of the panel 20 by coupling means including a hook 36 and a spring 38.

In this embodiment, a shield apparatus 39 is disposed on the color selection apparatus 30 to shield the electron beams from the geomagnetism affecting the emission trace defined by the frame 34. The shield apparatus 39 includes a main shield member 40 and a sub-shield member 42.

The main shield member 40 includes a main body 40*b* provided with an electron beam-passing opening 40*a* defining the electron beam emission trace, and it is disposed on the top of the supporting members 34*a* of the frame 34, with a skirt 40*c* integrally formed with the main body 40*b* extended downward to skirt the longitudinal sidewalls of the frame 34.

The skirt 40*c* is extended toward the phosphor screen 22 over the mask 32 and is fixed on the supporting members 34*a*.

The sub-shield member 42 is separately formed from the main shield member 40 and is disposed on sidewalls of the elastic member 34*b*. The sub-shield member 42 includes a longitudinal shielding part 42*a* disposed in a longitudinal direction to cover the space between the mask 32 and the elastic member 34*b*, and bridges 42*b* integrally extended from the shielding part 42*a* and fixed on the elastic members 34*b*. The width of the longitudinal shielding part 42*a* is designed to be greater than that of the lateral sides of the frame 34.

Figure 3:
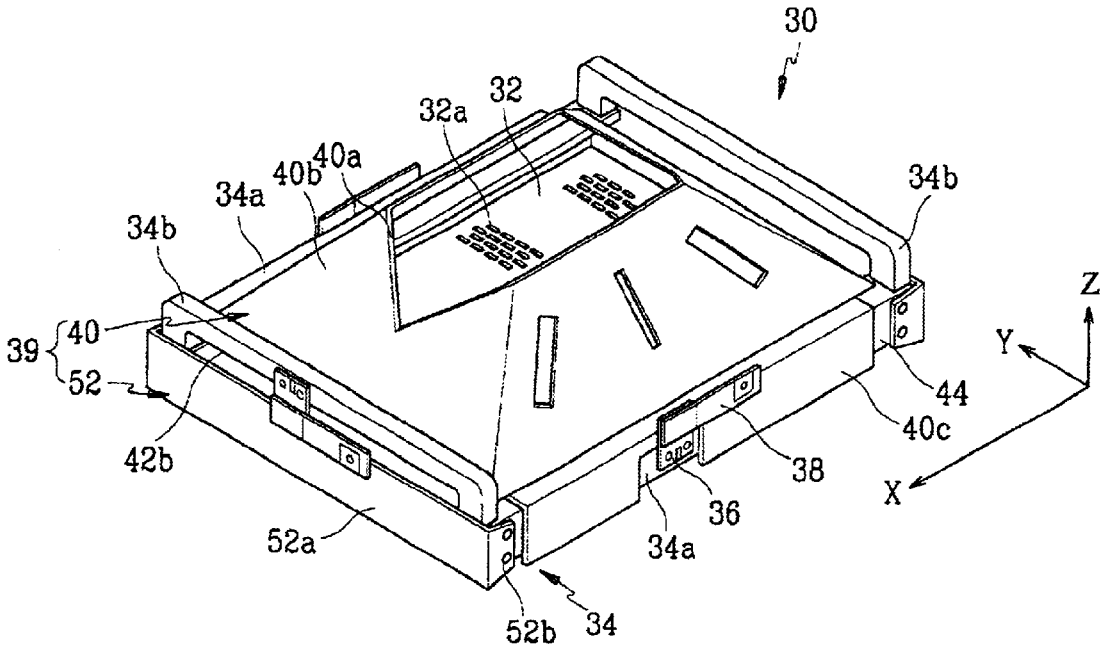
FIG. 3 is a perspective view of a modified example of a color selection apparatus according to the present invention.

FIG. 3 shows an modified example of a sub-shield member of the present invention.

In this example, a sub-shield member 52 includes a shielding part for covering a space between the lateral sides of the frame 32 and the elastic member 34*b* and a fixing (securing) part 52*b* bent at both ends of the shielding part 52*a* and fixed on the supporting member 34*a* by for example welding.

The skirt 40*c* of the main shield member 40 covers the central portion of the supporting member 34*a* and is asymmetrical with reference to the central portion of the supporting member 34*a*. In addition, the main shield member 40 defines the main body 40*b* and is designed not to cover the elastic members 34*b* defining the lateral sides of the frame 34.

Furthermore, as shown in FIG. 4, the skirt 40*c* is preferably connected to the supporting members 34*a* while satisfying the following condition E1:

$$0.01\ \text{mm} \leqq tk/L \leqq 0.15\ \text{mm (millimeters)} \qquad \text{E1}$$

where t is a thickness of the skirt 40*c*, k is a length of the skirt 40*c* extending from the mask 32 toward the phosphor screen 22, and L is a height of the supporting member 34*a*. Further, preferably the skirt 40*c* and the supporting members 34*a* is connected to the supporting members 34*a* while satisfying the following condition:

$$0.04\ \text{mm} \leqq tk/L \leqq 0.12\ \text{mm}.$$

Such conditions can be applicable to the sub-shield member 42. That is, as shown in FIG. 2, the sub-shield member 42 is preferably fixed on the supporting member 34*a* under the following condition E2:

$$0.01\ \text{mm} \leqq t'k'/L \leqq 0.15\ \text{mm} \qquad \text{E2}$$

where t' is a thickness of the sub-shield member 42, k' is a length of the sub-shield member 42 extending from the mask 32 toward the phosphor screen 22, and L' is a height of the supporting member 34*a*. Further preferably, the sub-shield member 42 is fixed on the supporting member 34*a* under the following condition:

$$0.04\ \text{mm} \leqq t'k'/L \leqq 0.12\ \text{mm}.$$

The ranges of tk/L and t'k'/L are obtained through a couple of tests by the applicants. That is, it has been noted that when the skirt 40*c* and the supporting members 34*a* or the sub-shield member 42 and the supporting members 34*a* are coupled to each other in a state where the tk/L and t'k'/L are maintained less than 0.01 mm, the effectiveness obtained from the main shield member 40 and the sub-shield member cannot be expected, and when the skirt 40*c* and the supporting members 34*a* or the sub-shield member 42 and the supporting members 34*a* are coupled to each other in a state where the tk/L and t'k'/L are maintained greater than 0.15 mm, although the effectiveness obtained from the main shield member 40 and the sub-shield member can be expected, it is difficult to actually manufacture the CRT including such main shield member 40 and the sub-shield member 42.

When the main shield member 40 and the sub-shield member 42 are applied to the color selection apparatus 30, the body 40*b* of the main shield member 40 is disposed toward the neck 24, and the skirt 40*c* of the main shield member 40 and the longitudinal shield part 42*a* of sub-shield member 42 are disposed on the perimeter (or circumference) of the frame 34. At this point, the skirt 40*c* and the shielding part 42*a* are disconnected at the corners of the frame 34 to define disconnection parts 44. Furthermore, the skirt 40*c* and the shielding part 42*a* are further extended toward the phosphor screen 22 to enclose the perimeter (or circumference) of the frame 34.

Accordingly, in a state where the color selection apparatus 30 employing the inventive shield apparatus 39 is mounted inside the panel 20 as shown in FIG. 2, even when the geomagnetism is applied to the cathode ray tube, the affect of the geomagnetism on the electron beams emitted from the electron gun 28 to scan the phosphor screen 22 can be minimized.

Describing in more detail, the electron beams from the electron gun 28 are first deflected by the deflection yoke 26 and directed toward the color selection apparatus 30. At this point, the main body 40*b* of the main shield member 40 shields the electron beams from the geomagnetism.

After passing through the color selection apparatus 30, the electron beams are directed toward the phosphor screen 22, during the course of which the skirt 40*c* and the shielding part 42*a* prevent the geomagnetism from applying to the lateral sides 20*b* of the panel. Hence, the skirt 40*c* shields the electron beams from the N-S horizontal component of the geomagnetism and the shielding part 42*a* shields the electron beams from the E-W horizontal component of the geomagnetism.

That is, the skirt 40*c* shields the electron beams from the horizontal geomagnetism component applied in the direction in parallel with the tube axis, and the shielding part 42*a* shields the electron beams from the horizontal geomagnetism component applied in the vertical direction with respect to the tube axis. Accordingly, even during the course of passing through the color selection apparatus 30, the electron beams are not affected by the geomagnetism. Furthermore, since the skirt 40*c* and the shielding part 42*a* are extended toward the phosphor screen 22 while enclosing the frame 34, the geomagnetism components flowing toward the mask 32 or the supporting members 34*a* can be prevented.

In addition, since the skirt 40*c* and the shielding part 42*a* are disconnected from each other by the disconnection parts 44, the E-W horizontal component of the geomagnetism applied to the shielding part 42 is not directed to the longitudinal sides of the frame 34, but is interrupted by the shielding part 42.

As described above, the electron beams of the cathode ray tube of the present invention are less affected by the horizontal geomagnetism component when compared with those of the conventional cathode ray tube. This will be described more in detail with reference to FIGS. 5A and 5B.

Figure 5A:
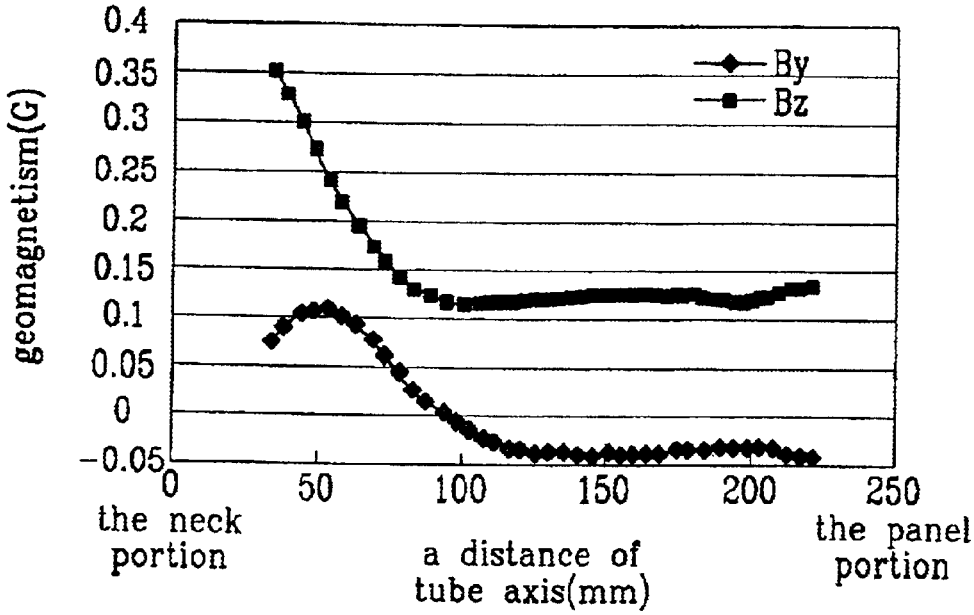
FIG. 5A is a graph illustrating a distribution curve of a horizontal component of the geomagnetism generated according to the present invention.
Figure 5B:
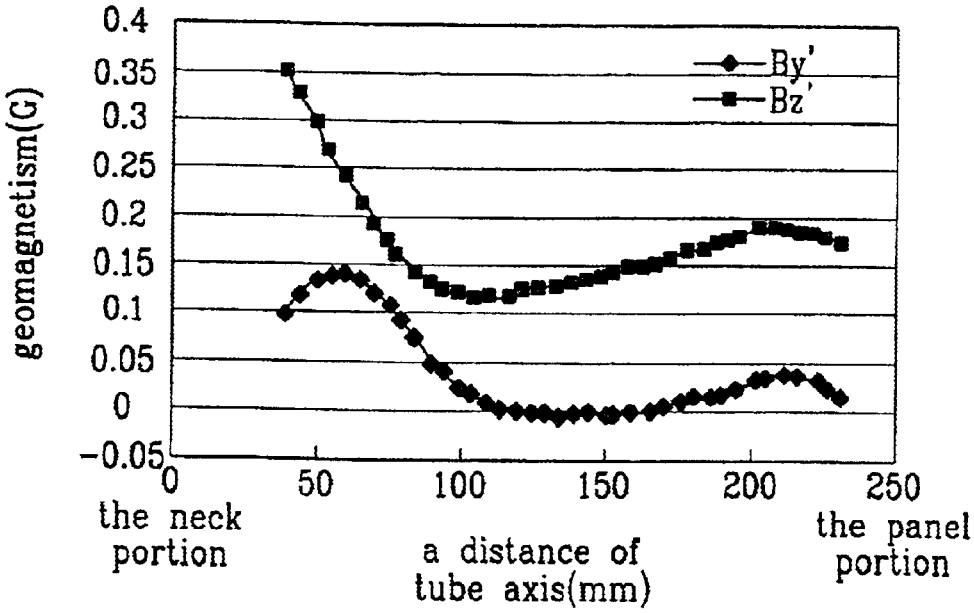
FIG. 5B is a graph illustrating a distribution curve of a horizontal component of the geomagnetism generated according to the prior art.

FIG. 5A shows a graph illustrating an N-S direction graph of the geomagnetism distributed from the neck to the panel along the tube axis according to the present invention, and FIG. 5B shows a graph illustrating an N-S direction graph of the geomagnetism distributed from the neck to the panel along the tube axis according to the prior art. In the drawings, FIGS. 5A and 5B, the geomagnetism is expressed in units of gauss (G) and the distance of the tube axis is in millimeters (mm). In the drawings, By and By' represent magnetic fields in a vertical direction of the panel, which are generated when the N-S component of the geomagnetism passes the shield apparatus (an inner shield in the prior art), and Bz and Bz' represent magnetic fields in a direction of the tube axis Z, which are generated when the N-S component of the geomagnetism passes the shield apparatus (an inner shield in the prior art).

The geomagnetism characteristics graphs are obtained from a CRT with a 34-inch screen having a 3:4 screen ratio. In the present invention, the tk/L and tk'/L are set to be 0.11 mm.

As shown in the graphs, the By and Bz from the neck to the funnel of the present invention have distribution curves that are similar to those of By' and Bz' of the prior art, while the By and Bz at the panel where the inventive shield apparatus have distribution curves less than those of the By' and Bz' at the prior panel.

Such distribution curves of the By and Bz shows that the inventive shield apparatus reduces the geomagnetism applied in a direction of the tube axis Z. Accordingly, the electron beams passing through the color selection apparatus 30 and landed on the phosphor screen 22 are less affected by the geomagnetism. That is, the horizontal shift of the electron beams is reduced so that the electron beams can be landed on desired phosphors.

Furthermore, it has been noted through a number of tests that when the skirt 40*c* and the shielding part 42*a* are mounted on the frame 34 while satisfying the above condition E1, the mis-landing of the electron beams caused by the N-S component of the geomagnetism is reduced by 29% from the prior art and the mis-landing of the electron beams caused by the E-W component of the geomagnetism is reduced by 16% from the prior art.

Figure 6A:
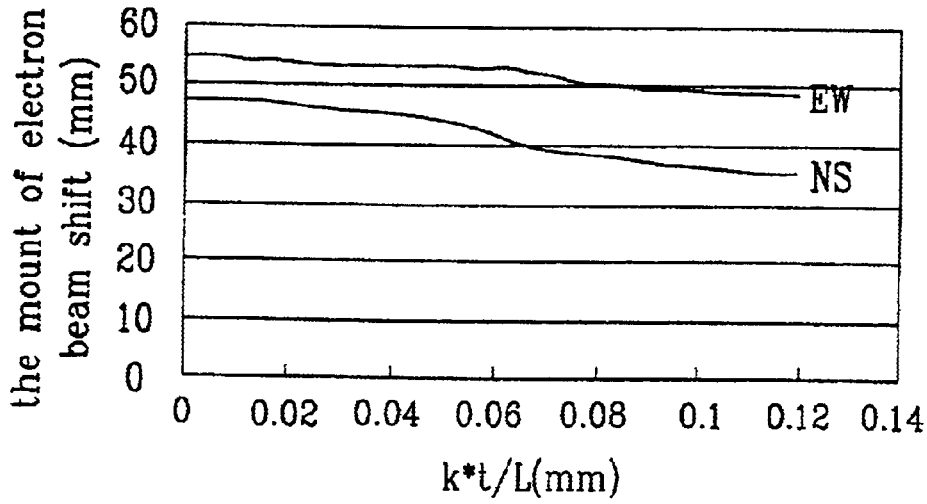
FIGS. 6A and 6B are graphs illustrating the relation between k1/L and the amount of electron beam shift in the present invention.
Figure 6B:
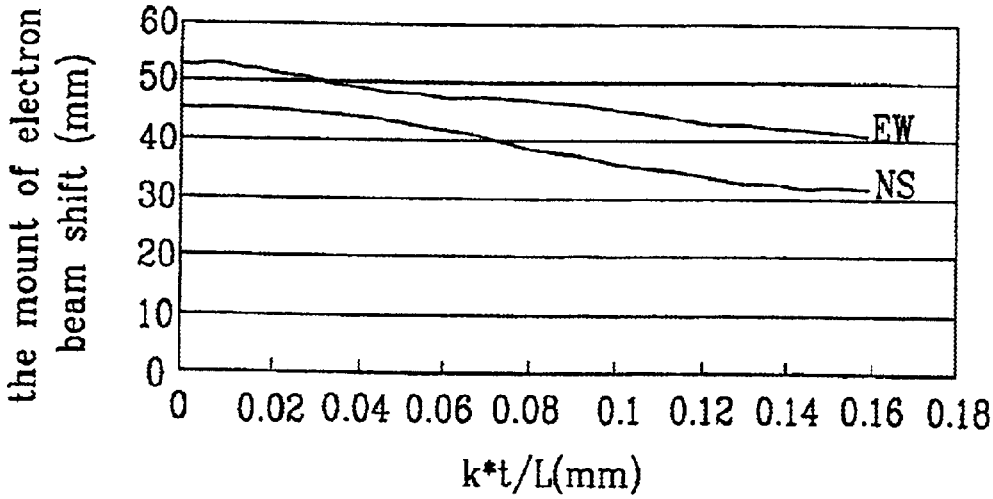

FIGS. 6A and 6B show relations between the electron beam shift and the kt/L and k't'/L with respect to the diagonal length of screens (32 inch CRT in FIG. 6A and 34 inch CRT in FIG. 6B) when the kt/L and k't'/L satisfy the above described conditions. For the reference, the value of the kt/L and k't'/L are set to be identical to each other.

As shown in the drawings, it has been noted the CRT of the present invention can reduce the electron beam shift with respect to the geomagnetism in N-S and E-W directions as the value of the kt/L is increased (i.e., above 0.01 mm).

At this point, as described above, it is preferable that the kt/L is maintained less than 0.15 mm. Describing more in detail, in a 32 inch CRT, when the kt/L is 0.07 mm, the most effectiveness can be obtained, and in a 34 inch CRT, when the kt/L is 0.11 mm, the most effectiveness can be obtained.

While this invention has been described in connection with what is presently considered to be the most practical and preferred embodiments, it is to be understood that the invention is not limited to the disclosed embodiments, but, on the contrary, is intended to cover various modifications and equivalent arrangements included within the spirit and scope of the appended claims.

What is claimed is:

1. A cathode ray tube, comprising:

a panel including a front screen portion and a panel flange formed on an edge of said front screen portion, a phosphor screen being formed on said screen portion;

a funnel connected to said panel flange;

a deflection yoke disposed around the funnel;

a neck connected to said funnel;

an electron gun disposed in said neck;

a color selection apparatus selecting electron beams emitted from said electron gun and allowing the selected electron beams to land on corresponding phosphors, said color selection apparatus comprising a frame including a pair of supporting members disposed at a predetermined distance from each other in parallel and a pair of elastic members secured on both ends of said supporting members to correspond to lateral sides of a mask; and a shield apparatus for shielding geomagnetism, said shield apparatus mounted on a perimeter of said frame of said color selection apparatus and extended toward said neck, said shield apparatus includes disconnection parts defined corresponding to corners of said frame, said shield apparatus being extended toward the phosphor screen over one of longitudinal and lateral sidewalls of said frame.

2. The cathode ray tube of claim 1, said shield apparatus further comprising a main shield member including a body provided with an electron beam-passing opening and extended toward said neck, and a skirt extended from said body and disposed on longitudinal sides of said frame; and a sub-shielding member disposed on lateral sides of said frame.

3. The cathode ray tube of claim 2, said skirt being secured on said supporting members while covering a center of said supporting members.

4. The cathode ray tube of claim 3, said skirt being formed to be asymmetrical with reference to a central portion of said supporting members.

5. The cathode ray tube of claim 2, said main shield member being mounted on said frame while not enclosing said elastic members.

6. The cathode ray tube of claim 2, said sub-shield member further comprising:

a shielding part disposed along the lateral sides of said frame to cover a space defined between said mask and said elastic members; and bridges extended from said shielding part and secured on said elastic members.

7. The color selection apparatus of claim 6, further comprised of a width of said shielding part being greater than a width of said frame.

8. The cathode ray tube of claim 2, said sub-shield member further comprising:

a shielding part disposed along the lateral sides of said frame to cover a space defined between said mask and said elastic members; and a securing part bent at both ends of said shielding part and securing on said supporting members.

9. The cathode ray tube of claim 2, said skirt being connected to said supporting members while satisfying the following condition:

$$0.01\ \text{mm} \leqq tk/L \leqq 0.15\ \text{mm}$$

where t is a thickness of said sub-shield member, k is a length of said skirt extending from said mask toward said phosphor screen, and L is a height of said supporting member.

10. The cathode ray tube of claim 9, said skirt being connected to said supporting members while satisfying the following condition:

$$0.04\ \text{mm} \leqq tk/L \leqq 0.12\ \text{mm}.$$

11. The cathode ray tube of claim 9, said sub-shield member being secured on said supporting member under the following condition:

$$0.01\ \text{mm} \leqq t'k'/L \leqq 0.15\ \text{mm}$$

where t' is a thickness of said sub-shield member, k' is a length of said sub-shield member extending from said mask toward said phosphor screen, and L' is a height of said supporting member.

12. The cathode ray tube of claim 11, said sub-shield member being secured on said supporting member under the following condition:

$$0.04\ \text{mm} \leqq t'k'/L \leqq 0.12\ \text{mm}.$$

13. A cathode ray tube, comprising:

a color selection apparatus selecting electron beams emitted from an electron gun and allowing the selected electron beams to land on corresponding phosphors, said color selection apparatus comprising a frame including a pair of supporting members disposed at a predetermined distance from each other in parallel and a pair of elastic members secured on both ends of said supporting members to correspond to lateral sides of a mask; and a shield apparatus shielding from geomagnetism and being mounted on a perimeter of said frame of said color selection apparatus and extended toward a neck of said cathode ray tube, said shield apparatus being extended toward a phosphor screen over one of longitudinal and lateral sidewalls of said frame, said shield apparatus, comprising:

a main shield member including a skirt disposed on the longitudinal sides of said frame; and a sub-shield member disposed on the lateral sides of said frame, said sub-shield member covering a space defined between said mask and said elastic members.

14. The cathode ray tube of claim 13, further comprising a disconnection part defined by said skirt and said sub-shield member being disconnected from each other.

15. The cathode ray tube of claim 14, said disconnection part being at the corners of said frame.

16. The cathode ray tube of claim 13, said sub-shielding member further comprising:

a shielding part being arranged in a longitudinal direction to cover the space between said mask and said elastic member; and a bridge integrally extending from said shielding part and being secured to said elastic members.

17. The cathode ray tube of claim 13, said sub-shielding member further comprising:

a shielding part covering a space between the lateral sides of said frame and said elastic member; and a securing part being bent at both ends of said shielding part and secured on said supporting member.

18. The cathode ray tube of claim 13, said skirt covering a central portion of said supporting member and being asymmetrical with reference to the central portion of said supporting member, said skirt being connected to said supporting members while satisfying a condition based on a thickness of said skirt, a length of said skirt extending from said mask toward said phosphor screen, and a height of said supporting member.

19. The cathode ray tube of claim 13, said sub-shield member being connected to said support members while satisfying a condition based on a thickness of said sub-shield member, a length of said sub-shield member extending from said mask toward said phosphor screen, and the height of said supporting members.

20. A cathode ray tube, comprising:

a color selection apparatus selecting electron beams emitted from an electron gun and allowing the selected electron beams to land on corresponding phosphors, said color selection apparatus comprising a frame including a pair of supporting members disposed at a predetermined distance from each other in parallel and a pair of elastic members secured on both ends of said supporting members to correspond to lateral sides of a mask; and a shield apparatus shielding from geomagnetism and being mounted on a perimeter of said frame of said color selection apparatus and extended toward a neck of said cathode ray tube, said shield apparatus being extended toward a phosphor screen over one of longitudinal and lateral sidewalls of said frame, said shield apparatus, comprising:

a main shield member including a skirt disposed on longitudinal sides of said frame, said skirt being secured to said supporting members, covering a central portion of said supporting member and being asymmetrical with reference to the central portion of said supporting member;

a sub-shield member disposed on lateral sides of said frame, said sub-shield member covering a space defined between said mask and said elastic members, a width of said sub-shielding member being greater than a width of the lateral sides of said frame; and a disconnection part defined by said skirt and said sub-shield member being disconnected from each other at the corners of said frame.

* * * * *